US006470602B2

(12) United States Patent
White, III et al.

(10) Patent No.: US 6,470,602 B2
(45) Date of Patent: Oct. 29, 2002

(54) SNOWTHROWER HAVING IMPELLER ASSIST PROPULSION

(75) Inventors: Donald M. White, III, Chanhassen, MN (US); Thomas J. Beckey, Edina, MN (US); John T. Gill, Savage, MN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 09/944,577

(22) Filed: Aug. 31, 2001

(65) Prior Publication Data

US 2002/0020083 A1 Feb. 21, 2002

Related U.S. Application Data

(63) Continuation of application No. 09/511,521, filed on Feb. 23, 2000.

(51) Int. Cl.[7] ..... E01H 5/09
(52) U.S. Cl. ..... 37/244
(58) Field of Search ..... 37/247, 248, 249, 37/252, 253, 250, 257, 244, 245, 246

(56) References Cited

U.S. PATENT DOCUMENTS 2,229,229 A * 1/1941 Wagner
2,632,263 A * 3/1953 Cooper
2,685,751 A * 8/1954 Bain
2,941,223 A * 6/1960 Klauer
3,021,620 A * 2/1962 Rosenthal
3,074,189 A * 1/1963 Phelps
3,774,321 A * 11/1973 David
4,295,285 A * 10/1981 Stevens
4,480,397 A * 11/1984 Vachon
4,756,101 A * 7/1988 Friberg et al.
4,825,570 A * 5/1989 Schmid et al.
5,083,387 A * 1/1992 Tillotson et al.
5,398,431 A * 3/1995 Beihoffer et al.
5,410,825 A * 5/1995 Perrelli
5,735,064 A * 4/1998 Holl
6,154,985 A * 12/2000 Champagne et al.

* cited by examiner

*Primary Examiner*—Victor Batson
(74) *Attorney, Agent, or Firm*—Fulbright & Jaworski L.L.P.

(57) ABSTRACT

An improved single-stage snow thrower including a wheeled frame assembly for supporting the snow thrower upon a ground surface and a driven impeller capable of being placed in ground contact to forwardly propel the snow thrower across the ground surface. A handle assembly including a user interface is further provided to permit the operator to selectively control the normal force associated with the driven impeller, and thus selectively control the propulsive drive force of the snow thrower. A bail control assembly may be provided upon the handle to permit the operator to selectively control a downward movement of the impeller to selectively control the degree of impeller ground contact.

34 Claims, 8 Drawing Sheets

SNOWTHROWER HAVING IMPELLER ASSIST PROPULSION

RELATED APPLICATION

This is a continuation of application Ser. No. 09/511,521, filed Feb. 23, 2000. This application claims the benefit of priority pursuant to 35 U.S.C. §120 of copending U.S. patent application Ser. No. 09/511,521, filed Feb. 23, 2000.

FIELD OF THE INVENTION

The invention relates to single-stage snowthrowers, and more particularly to a single-stage snow thrower having impeller assisted propulsion.

BACKGROUND OF THE INVENTION

Powered walk-behind snowthrowers for consumer and commercial markets are well known. Such snowthrowers generally include a wheel supported body or frame having a housing with a generally open front, a pair of side walls, a rear wall and a discharge chute communicating with at least the rear wall. Single-stage snowthrowers are so named because they utilize a single powered implement, the impeller, for picking up and throwing snow outwardly away from the snowthrower. In contrast, two stage snowthrowers utilize two separate powered implements for handling snow, a low speed, high torque auger for breaking up and feeding snow rearwardly, and a high speed impeller for receiving the snow and throwing the snow outwardly.

Many dual stage snowthrowing machines are robust in dimension and weight, often defining swath widths of 24–32 inches. Dual stage machines often include a large internal combustion engine (6–15 hp) to supply power requirements for both the auger and impeller, in addition to the propulsion drive system. Dual stage snowthrowers may be propelled by engine driven rear wheels or tracks.

In comparison, single-stage snowthrowers have typically smaller swath widths and are lighter in weight. While single-stage snowthrower performance characteristics (snow volume per minute, throw distance, etc.) now approach those of dual stage models, single-stage models have typically not been propelled through driven rear wheels. Rather, contemporary single-stage snowthrowers have been propelled by the operator applying a manual force to push the snowthrower forward. As larger and more powerful single-stage snowthrowers are developed, the ability of the operator to manually propel the snowthrower will be diminished.

It has been recognized that the impeller of a single-stage snowthrower may be used as a "drive" mechanism for assisting in propelling the snowthrower. The impeller of single-stage snowthrowers may include a flexible rubber element capable of engaging the ground surface during operation and developing a force tending to forwardly propel the snow thrower. The degree of ground engagement of the impeller (and thus the relative propulsion force developed by the impeller) may be increased by lifting the snowthrower by its handle thereby transferring a larger portion of the machine weight onto the impeller. Several conditions change as the handle is lifted by the operator—an increasing portion of the impeller contacts the ground, an increasing downward (normal) force is developed across the impeller contact region, and a gap may develop between a lower scraper and the ground (leading to incomplete snow removal). Overall, while the resulting self propelling action is desirable, the forward tilting of the snowthrower requires constant user exertion to maintain the drive force. Additionally, the force necessary to tilt the snowthrower for propulsion assist of the impeller increases with the weight of the snowthrower. As larger, more powerful single-stage snowthrowers are developed, the ease of the operator to utilize the tilt drive-assist feature to propel the snowthrower will be diminished.

Another limitation of some prior single-stage snowthrowers related to the self propelled operation (via handle tilting to increase impeller normal force) is the difficulty in controlling the snowthrower along a straight path. Upon tilting the handle upwardly, the lower scraper and rear wheels break contact with the ground surface and the snowthrower may be supported entirely upon the ground through the rotating impeller. A force vector may be developed by the ejected snow creating a reactive moment force tending to rotate the snowthrower in a direction opposite the directed snow. In order to maintain the snowthrower along a straight path, the operator may be required to provide an opposing force at the handle. On a low friction surface such as ice, the snowthrower may be difficult to control and may "skate" or slide sideways upon the surface.

SUMMARY OF THE INVENTION

The present invention provides a single-stage snowthrower having a wheeled frame or undercarriage and an impeller which is movably coupled to the frame. An impeller housing includes a generally open front, a pair of side walls, a rear wall and a discharge chute. A handle extends outwardly to define an operator station during use of the snowthrower. A flexible rubber impeller is rotatably carried within the impeller housing and may be driven via a variety of power coupling strategies.

One aspect of the present invention is an impeller housing which is movably coupled relative to the handle portion of the snowthrower. The impeller may be placed in variable ground contact by movably displacing the impeller housing with respect to the handle portion.

Another aspect of the present invention is an impeller housing which is pivotally coupled to the frame of the snowthrower, wherein the impeller housing is pivotably coupled with respect to a pivot axis. In one embodiment, the pivot axis may be aligned in parallel with an axis of impeller rotation.

Another aspect of the present invention is the provision of an impeller housing to which the engine of the snowthrower is coupled. In this regard, both the impeller housing and the engine are movably coupled relative to the frame element of the snowthrower.

Yet another aspect of the present invention is the selective control of the impeller housing movement. The selective control of the impeller's contact with the ground surface may be via a bail assembly adapted for user manipulation during machine operation. In one embodiment the bail assembly may control both the impeller housing movement and the clutch engagement for powering the impeller during operation.

Yet another aspect of the present invention is a single-stage snowthrower which may be propelled across the ground surface by the rotating impeller with the rear wheels remaining in contact with the ground surface. During impeller-associated self-propel operation, the ground contacting rear wheels promote machine stability and ease of use. Additionally, during operation on certain low friction surfaces, the ground engaging rear wheels may tend to counteract moment forces generated by the ejected snow.

Still another aspect of the present invention is a snowthrower having a bottom scraper element which displays a range of motion relative to the impeller housing. The bottom scraper may be flexibly coupled to the impeller housing to permit movement in response to ground surface contact.

Other features and advantages of the present invention will become apparent to those of ordinary skill in the relevant arts upon review of the following detailed drawings, description of preferred embodiments, and claims.

BRIEF DESCRIPTION OF THE DRAWING

Preferred embodiments of the invention will be described in detail hereinafter with reference to the accompanying drawings, in which like reference numeral refer to like elements throughout, wherein:

FIG. 3 is a perspective illustration of a detailed portion of the single-stage snowthrower of FIG. 1;

DETAILED DESCRIPTION OF PREFERRED EMBODIMENTS

Figure 1:
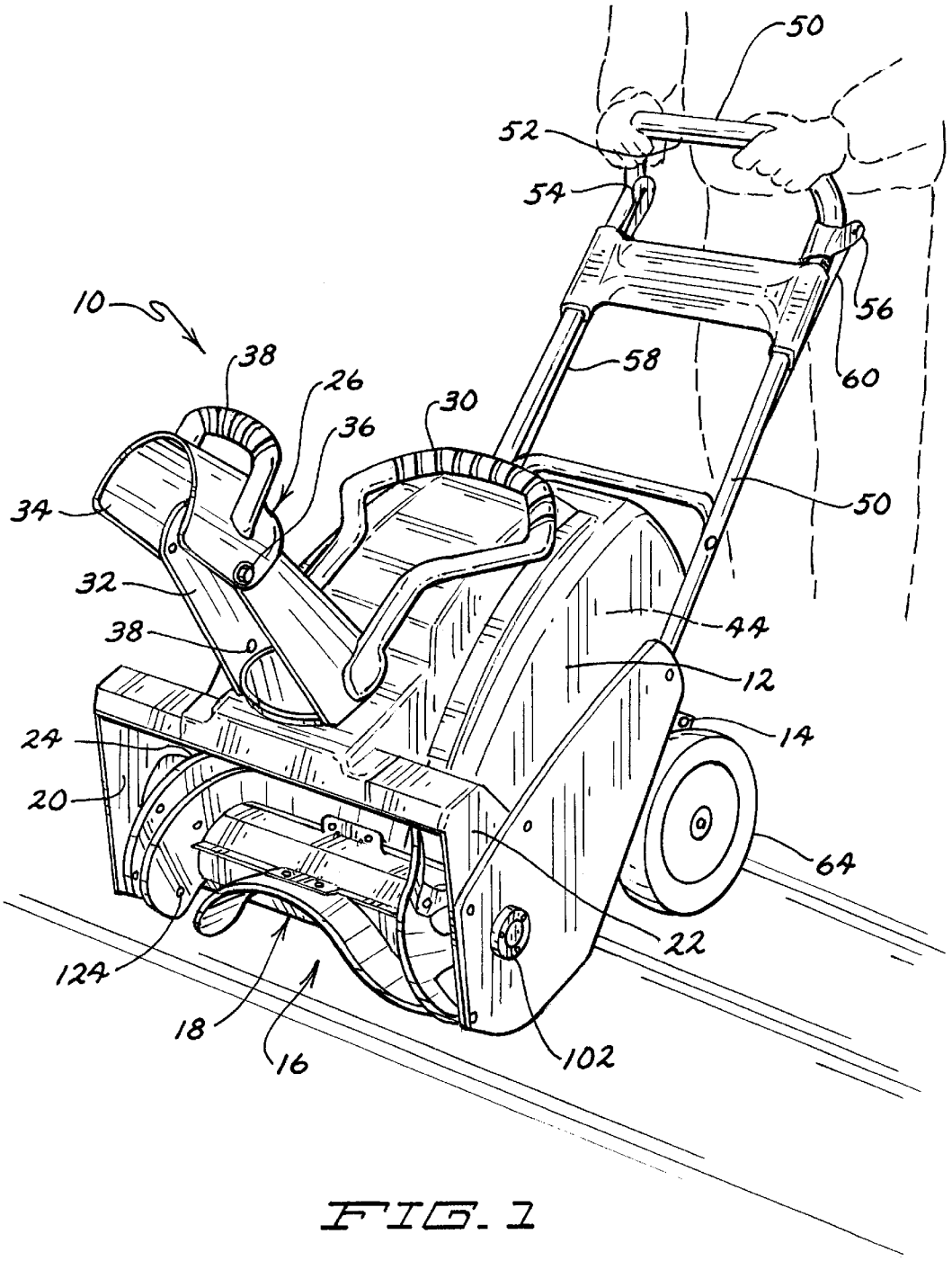
FIG. 1 is a perspective illustration of a preferred embodiment of a single-stage snowthrower according to the present invention.

Referring now to FIGS. 1–8, an improved snowthrower 10 according to the present invention is illustrated as 10. Snowthrower 10 includes a housing 12 carried upon an wheeled undercarriage or frame assembly 14. Housing 12 includes an open portion 16 in front of a snow-engaging impeller 18. Housing 12 further includes a pair of side walls 20, 22 and a rear wall 24. A chute assembly 26 communicatively cooperates with the open front portion 16 for accepting and directing snow ejected from the impeller 18 into an intended direction of dispersion 28. Chute assembly 26 may be directionally controlled by the operator via a chute handle 30 for adjusting the direction of the chute 26 relative to the impeller housing 12. Discharge chute assembly 26 includes a chute 32 and a deflector 34 which are interconnected at their overlapping ends by fixed pivots 36. A handle 38 is preferably provided on the deflector 34 to facilitate manual adjustment thereof. The main chute handle 30 may be coupled to the chute assembly 26 proximate its base end. The base end of the chute assembly 26 is operatively coupled to the top of the impeller housing 12 for rotation about a generally upright axis. During operation, rotational positioning of the chute assembly 26 is controlled by the chute handle 30. A detent mechanism (not shown) may be provide sufficient resistance to slippage to retain the chute assembly 26 in the desired rotational position during operation. Those skilled in the relevant arts will appreciate that the positioning of the chute assembly 26 may alternatively be controlled via a chute crank assembly (not shown), a remote crank assembly (not shown), such as disposed upon the handle 38, or a cable assembly(not shown).

Snowthrower 10 includes an internal combustion engine 44, or other suitable power source for powering the impeller 18. In the illustrated embodiment the engine 44 is disposed within the impeller housing 12. In other embodiments, the engine 44 may be disposed upon the frame 14 and not otherwise carried by the impeller housing 12. Those skilled in the relevant arts will appreciate that the engine 44, regardless of its position on the snowthrower 10, may be operatively and selectively coupled to the impeller assembly 18 through a variety of power conveying techniques and approaches, including but not limited to clutches, belts, pulleys, etc.

Still referring to FIG. 1, the snowthrower 10 includes an upwardly extending, generally U-shaped handle assembly 50 which is secured to the wheeled frame undercarriage 14. Handle assembly 50 further includes a user interface for controlling the position of the impeller assembly 18 relative to the frame 14 and the ground surface. The user interface is an impeller positioning device and may include a bail assembly 52 capable of being manipulated by an operator. User interface assembly 52 may include a single bail mechanism as illustrated, or alternatively, an interlocking bail mechanism (not shown), or a lever (not shown). Bail assembly 52 is movable between a first position and a second position relative to the handle assembly 50 and/or frame 14. As further described herein, user interface assembly 52 permits the operator to selectively vary the normal force, N, associated with the impeller assembly 18, and thus vary the forward drive force of the snowthrower 10. Bail assembly 52 includes a drive connection surface 54 and a clutch connection surface 56, each having an associated cable or linkage 58,60 for communicating with either the clutch assembly (not shown) or the housing 12 pivot assembly. Bail assembly 52, as further described herein, operatively couples the engine 44 to the impeller 18 to power the impeller 18 during operation. As further described herein, the bail assembly 52 selectively controls a downward movement of the impeller housing 12 relative to the frame assembly 14 to increase the ground contact of the impeller 18 and thus increase the amount of forward propulsion force created by the rotating impeller 18 during operation.

Figure 2:
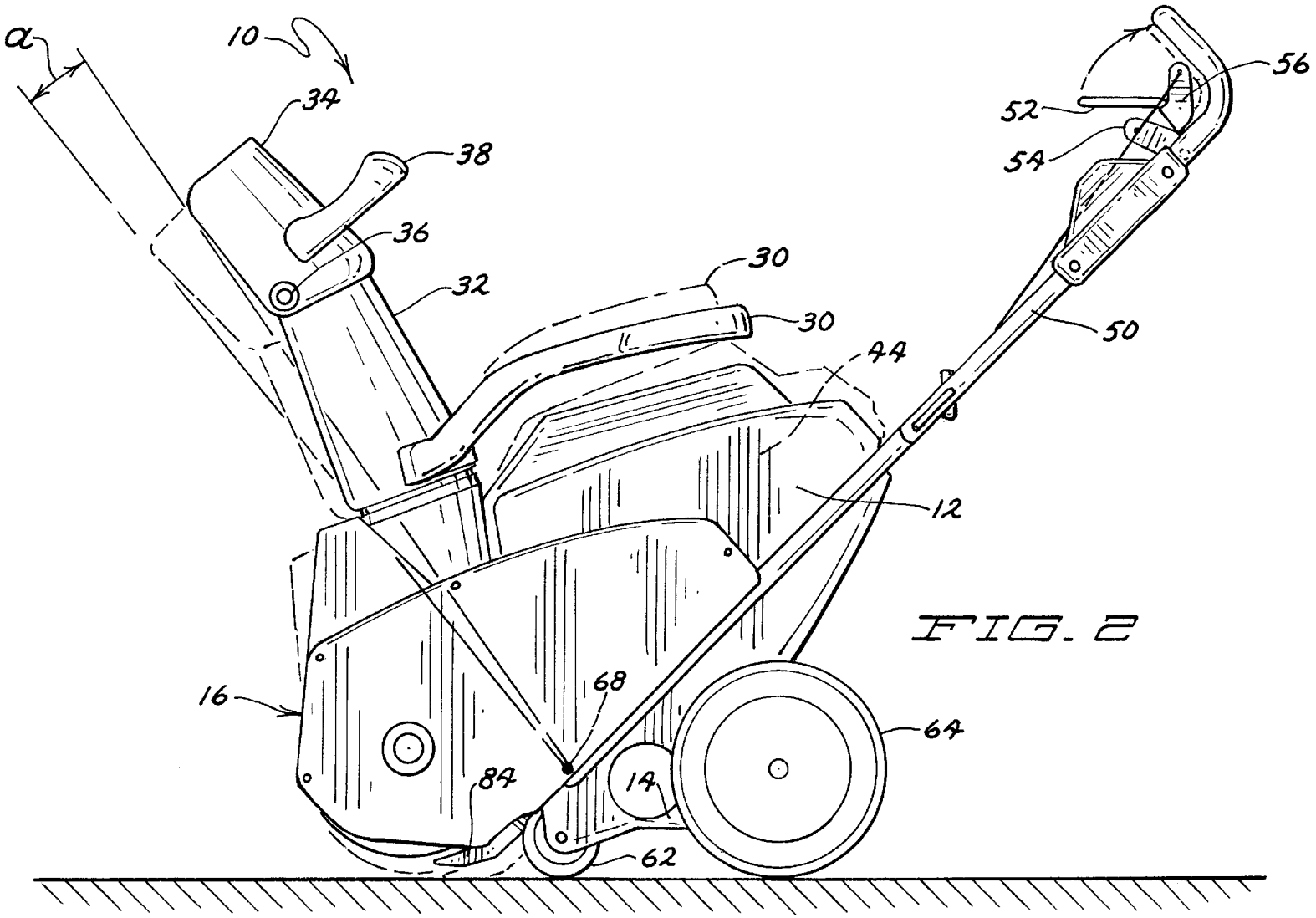
FIG. 2 is a side elevational view of the single-stage snowthrower of FIG. 1.
Figure 9:
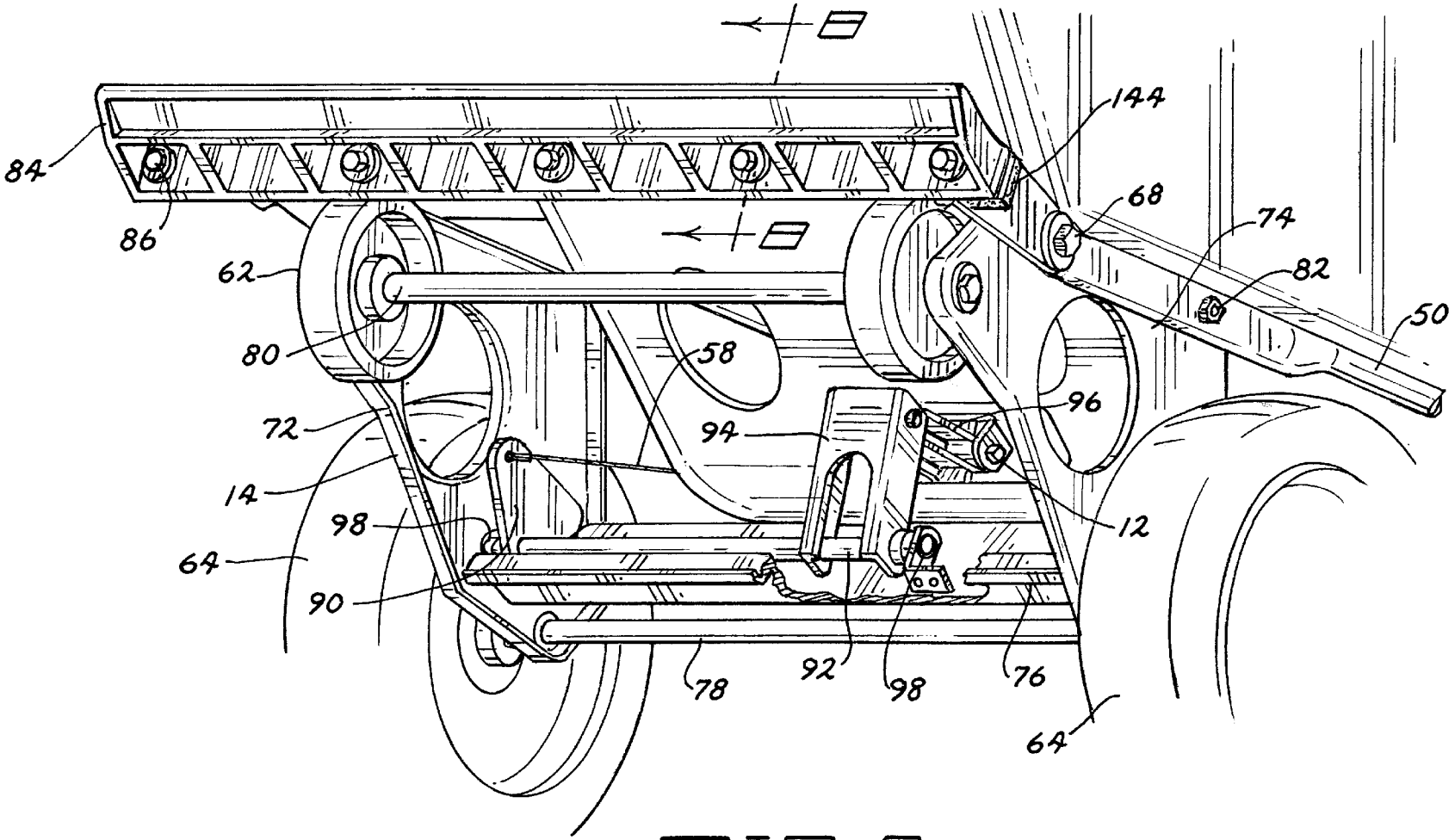
FIG. 9*a* is a diagrammatic side elevational illustration of a prior art single-stage snow thrower, depicting a non-propelled condition.
FIG. 9*b* is a diagrammatic side elevational illustration of a prior art single-stage snow thrower, depicting a propelled condition.

As illustrated particularly in FIG. 2, the frame assembly 14 include four wheels, defining a rear wheel set 62 and a front wheel set 64. Rear wheels 64 may be pneumatic, 10"×3.25" tires. During nonoperation of the impeller assembly 18 as depicted in FIG. 2, the snowthrower 10 rests on all four wheels 62,64 to facilitate movement, as during transport and storage. FIG. 2 further illustrates, in phantom lines, the selective movement of the impeller housing 12 relative to the frame 14 upon operator bail 52 movement. With the bail 52 in its released position (as illustrated) the impeller 18 is displaced a predetermined distance '$X_i$' from the ground surface. When the bail 52 is placed in the maximum activated position (illustrated with phantom lines) the housing 12 is pivoted about a pivot axis 68 across a predetermined arc of travel, $\alpha$, of approximately 11 degrees. As the housing 12 is pivoted, an upper portion of the housing 12 including the engine 44 and chute handle 40 are displaced away from the frame 14 while a lower portion of the housing 12 including the impeller 18 is displaced toward the ground surface. The degree of movement of the impeller 18 toward the ground surface may controlled by the operator by varying the position of the bail assembly 52 relative to the handle 50. As the bail assembly 52 is transitioned toward the handle 50, an increasing normal force, N, is developed between the impeller 18 and the ground surface to create an increasing propulsive force. The operator may bias the bail assembly 52 into an intermediate position to provide an intermediate propulsive force. In this regard, a user selectively controlled propulsion means is provided for a single-stage snowthrower 10.

Referring now to FIG. 3, the impeller housing 12 is pivotably coupled to the underframe assembly 14 of the snowthrower 10 along pivot axis 68. The underframe 14 includes a pair of opposed side wall members 72,74 coupled together through a rear cross brace member 76. Rear wheels 64 are supported by and disposed outside the side walls 72,74 on a rear axle 78. Front wheels 62 are supported between the side walls 72,74 on a front axle 80. The snowthrower handle 50 is coupled at each side wall 72,74 of the frame assembly 14 through threaded fasteners 82. A scraper element 84 is coupled to the frame 14 through threaded fasteners 86 allowing for replacement if necessary. The assembly for pivoting the impeller housing 12 relative the frame 14 includes the drive control cable 58 coupled to the bail 52 (not shown in FIG. 3) and a lever plate 90. Lever plate 90 is in turn operatively coupled to one end of a pivot rod 92. A crank 94 is operatively coupled to an opposed end of the pivot rod 92, and a connection link arm 96 is coupled at one end to the crank 94 and to the housing 12 at the opposed end. Pivot rod 92 is operatively supported upon the frame assembly 14 between a pair of journal bearings 98.

Figure 4:
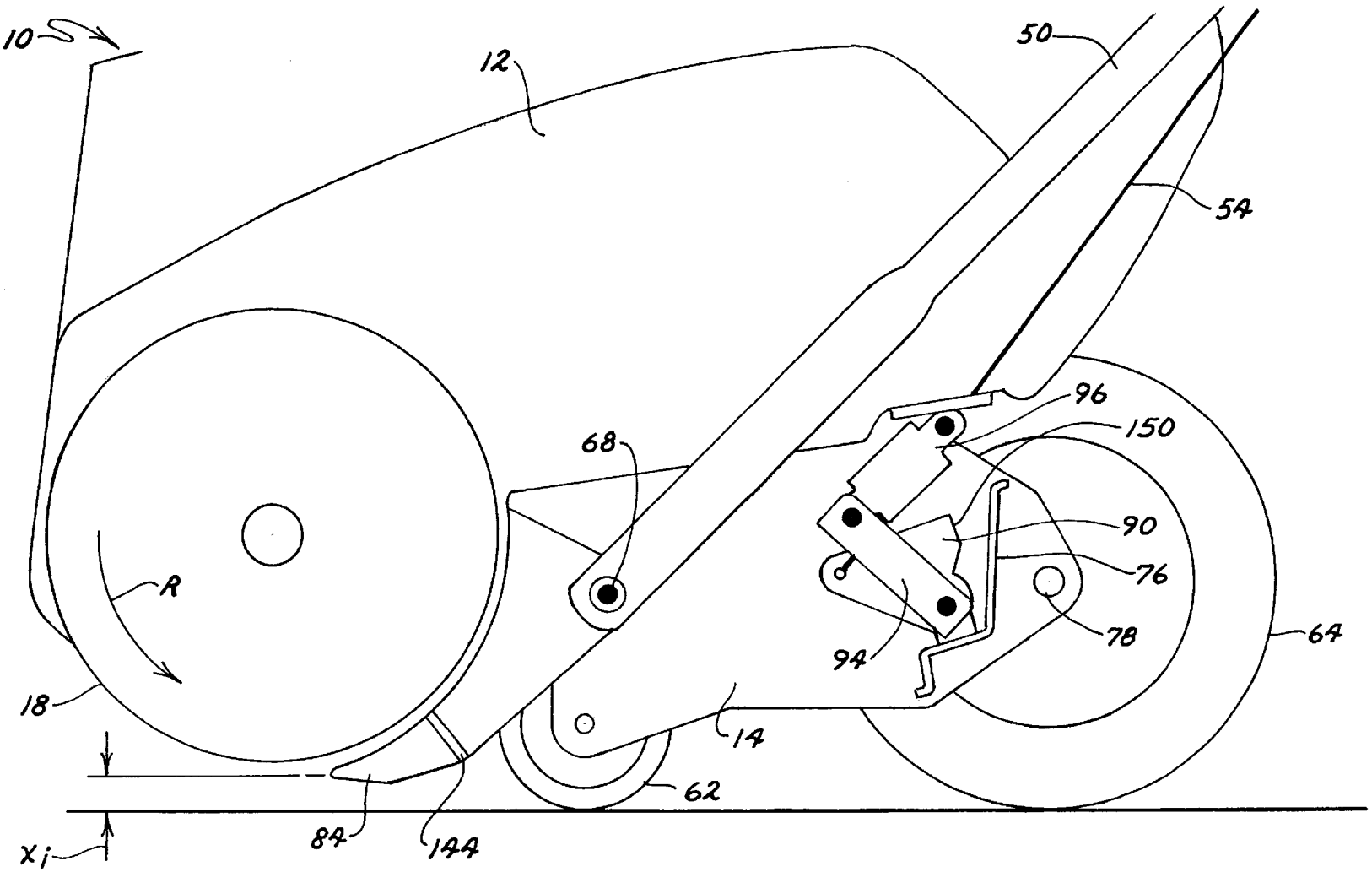
FIG. 4 is a diagrammatic side elevational illustration of the single-stage snowthrower of FIG. 1, depicting a nonoperational condition.
Figure 5:
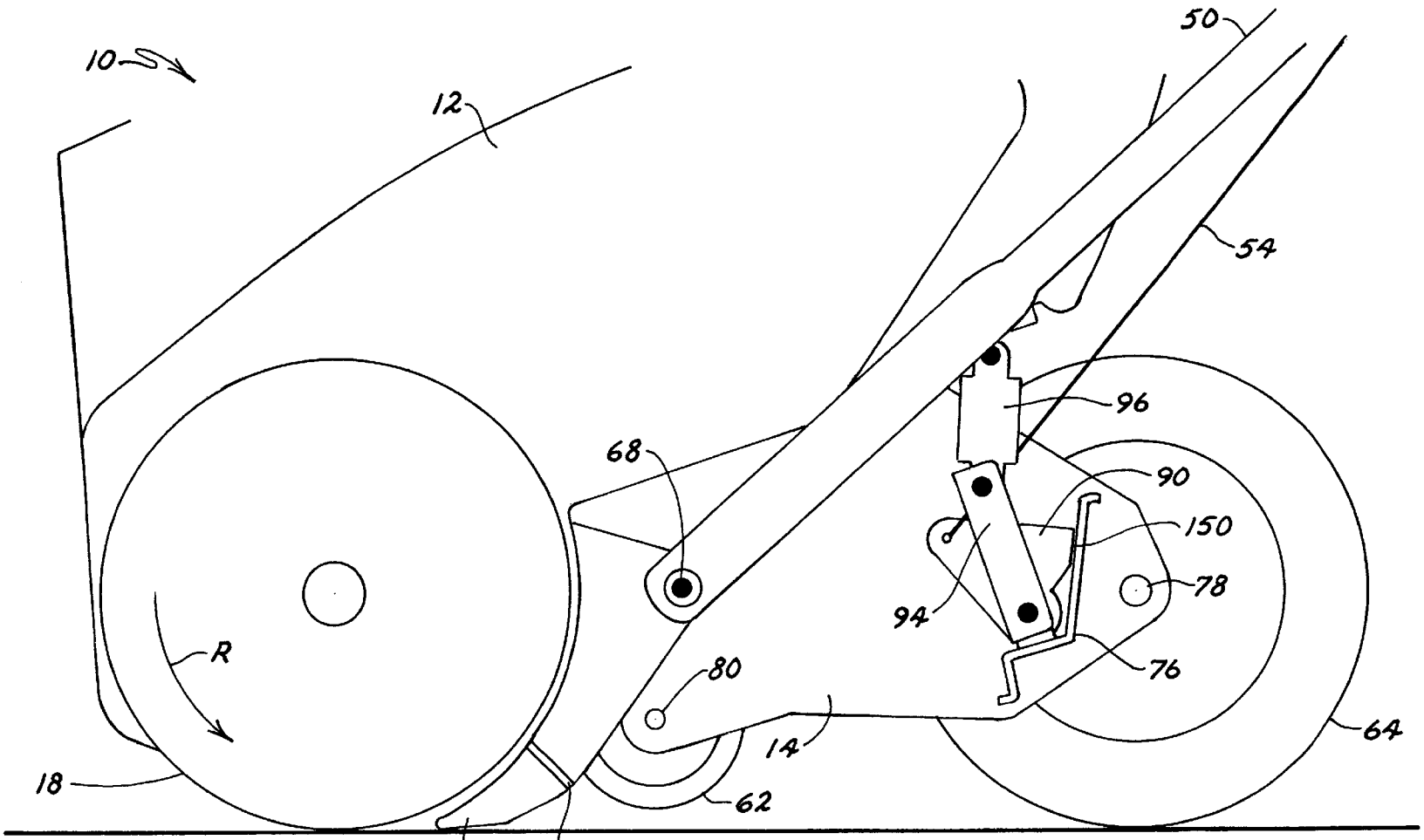
FIG. 5 is a diagrammatic side elevational illustration of the single-stage snowthrower of FIG. 1, depicting an operational condition.

FIGS. 4 and 5 illustrate diagrammatic side elevational views of the snowthrower 10 and depict a snowthrower 10 in a nonoperational condition (FIG.4 ) and in an operational condition (FIG. 5). Operation of the snowthrower 10 will be described in more detailed hereinafter.

Figure 6:
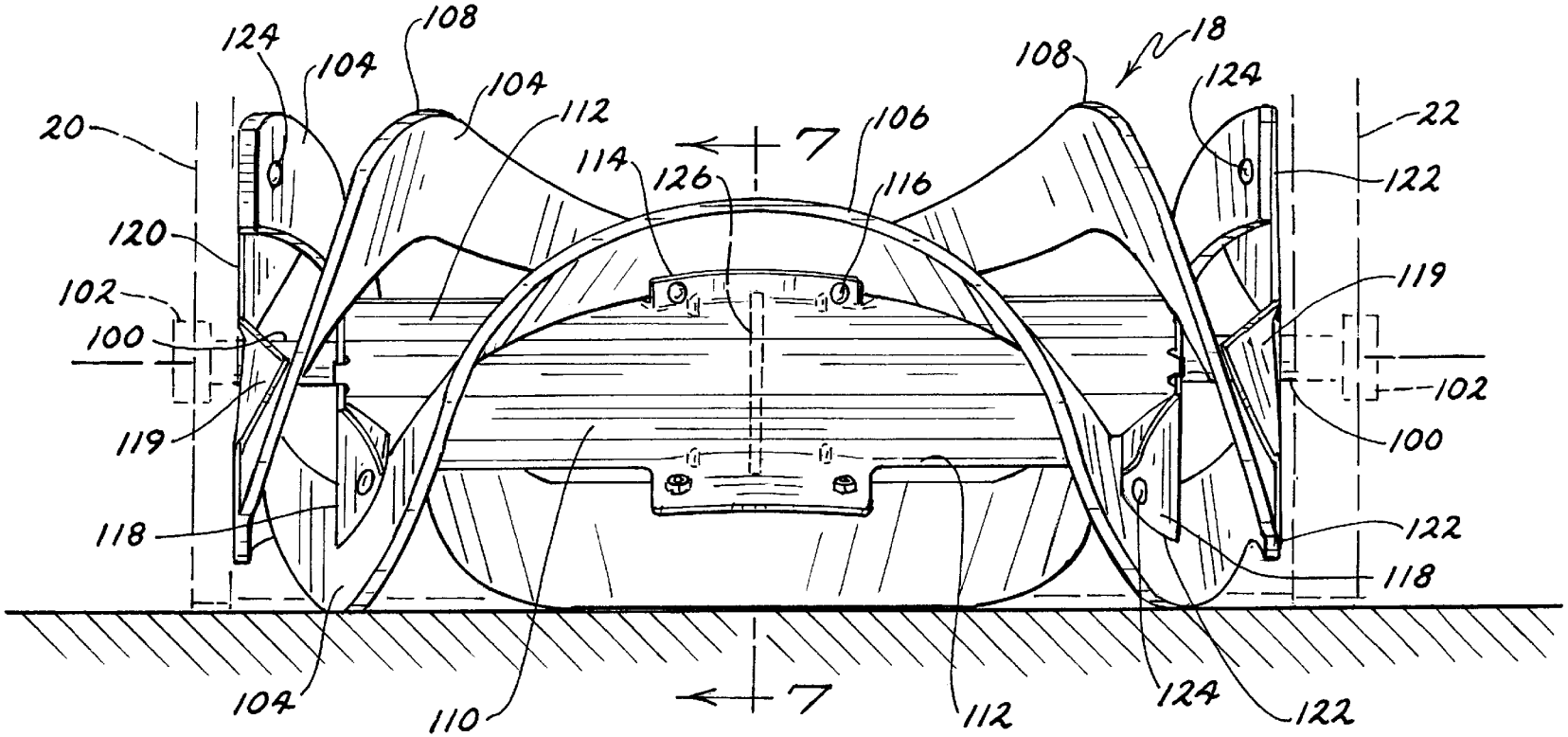
FIG. 6 is a front elevational view of a portion of the single-stage snowthrower of FIG. 1, illustrating the impeller assembly.
Figure 7:
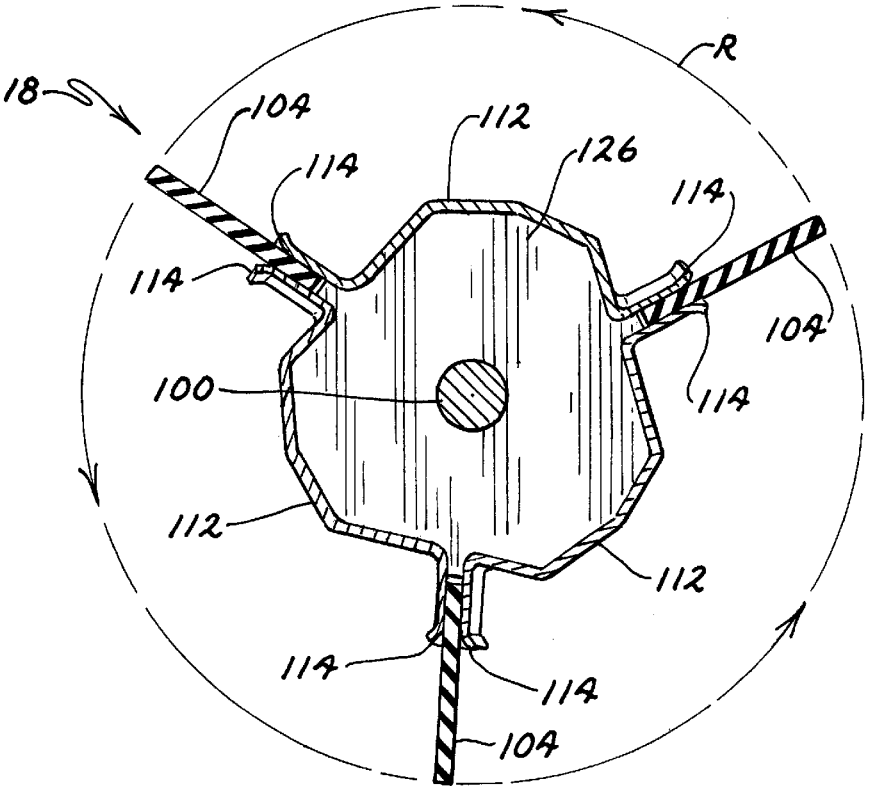
FIG. 7 is a cross sectional view of the impeller element of FIG. 6, taken along lines 7—7.

FIGS. 6 and 7 disclose the impeller assembly 18 of the snowthrower 10. The impeller 18 is supported for rotation within the housing 12 and rotates about a horizontal rotational axis. Specifically, the impeller 18 is mounted on a shaft 100 with suitable bearings 102 and is connected via the shaft 100 and a belt and pulley arrangement (not shown) to the drive motor 44. The impeller 18 is configured such that as the snow enters the impeller 18 chamber, the snow in the center of the chamber is propelled upwardly through the discharge chute 26 and the snow at either end of the impeller 18 chamber is moved first axially inwardly toward the center of the impeller 18 and then upwardly through the discharge chute 26.

Impeller 18 includes three outwardly extending paddles 104, identical in shape, which are offset 120 degrees from each other around the circumference of the impeller 18. Each paddle 104 includes a relatively long, central snowthrower section 106 coupled on either end by a relatively short, end section 108 that functions as an auger. Central section 106 is generally concave in shape between each end section 108 thereof. Each end section 108 defines a relatively small portion of a spiral auger for transporting snow inwardly toward the central section 106. Each paddle 104 is preferably made from a single piece of flexible material, such as a fiber reinforced rubber, which may be die cut out of sheet stock.

The impeller 18 includes a center cylindrical drum assembly 110 which is formed by three similarly shaped drum section 112. The three paddles 104 are retained at the central section between adjacent pairs of drum section clamping surfaces 114. Clamping surfaces 114 are concavely shaped to form the paddles 104 into the desired concave orientation. Threaded fasteners 116 are used to removably couple the paddles 104 to the cylindrical drum 110 at the central section 106. Each paddle 104 is coupled at an end section 108 to the driven shaft 100 by a pair of end stampings or plates, an inner plate 118, and an outer plate 119. Each end plate 118, 119 is shaped to define the auger-like end sections of the paddle 104. The inner plates 118 includes a central circular hub 120, preferably welded to shaft 100, and three radially extending ears 122. Each ear 122 is slanted at an oblique angle relative to the axis of shaft 100 to define the inwardly slanted orientation of each end section 108 as it functions as an auger. The paddles 104 are secured to the ears 122 by threaded fasteners 124. Similarly, each outer end plate 119, which is preferably welded to shaft 100, includes three configured surfaces each slanted at an oblique angle relative to the axis of shaft 100 to defined the inwardly slanted orientation of each end section 108 as it functions as an auger. The paddles 104 are secured to the outer plates 119 by threaded fasteners 124. Impeller 18 further includes a centrally disposed plate 126, preferably welded to shaft 100, and engaging internal surfaces of the cylindrical hub 110. Those skilled in the art will recognize that end plates 118 and central stamping 126 could be another type of member, such as a disk, spider, plate, or stamping, which functions to connect operatively couple the paddles 104 to the driven shaft 100. Additionally, entire impeller assembly 18 could take alternative form, such as a one-piece plastic drum assembly 110, etc.

Figure 8:
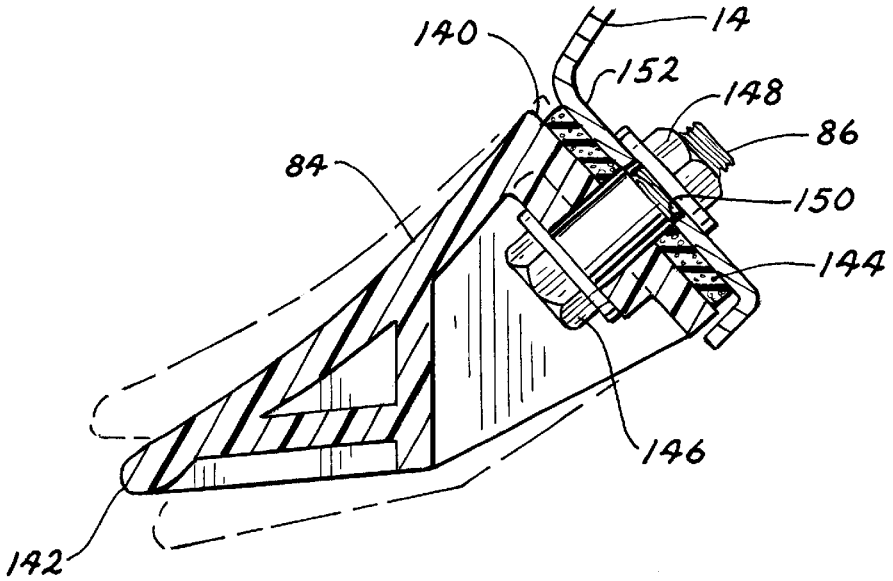
FIG. 8 is a cross sectional view of a scraper element of the single-stage snow thrower of FIG. 1, taken along lines 8—8.

Referring now to FIG. 8, a detailed illustration of the lower scraper 84 is provided. In a cross sectional view, scraper 84 is generally triangularly shaped to define a base portion 140 and an apex portion 142 for ground scraping action. Scraper 84 is made of polymeric material, such as high density polyethylene. Scraper element 84 is coupled to the undercarriage frame 14 of the snowthrower 10 through a plurality of threaded fasteners 86. A flexible foam-type material 144 is disposed between the scraper 84 and the frame 14. Threaded fasteners 86 may include a shoulder bolt 146 and nut 148. During assembly, the shoulder bolt 146 is passed through an aperture 150 of the scraper 84 and a portion 152 of the frame 14 is secured between the shoulder bolt 146 and nut 148. A diameter of the aperture 150 is larger than a diameter of the shoulder bolt 146 to allow for movement of the scraper 84. As illustrated in FIG. 8, the scraper 84 is permitted to cant or tilt relative to the frame assembly 14.

Figure 9A:
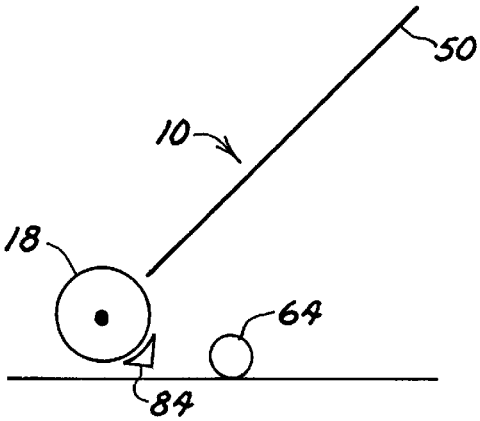
FIG. 9A PRIOR ART
Figure 9B:
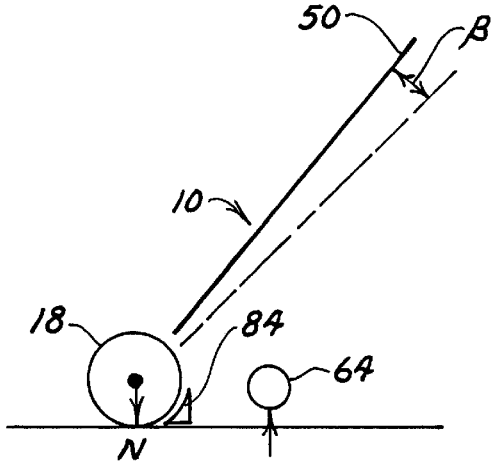
FIG. 9B PRIOR ART

FIGS. 9*a* and 9*b* illustrate a prior art single-stage snowthrower 10, wherein during operation the degree of ground engagement of the impeller 18 (and thus the relative propulsive force developed by the impeller 18) may be increased by lifting the snowthrower 10 by its handle 10. It has been recognized that the relative propulsive force is a function of the impeller 18 normal force, N. Several conditions change as the handle 50 is lifted by the operator—an increasing portion of the impeller 18 contacts the ground, an increasing normal force, N, is developed across the impeller 18 contact region, and a gap may develop between the lower scraper and the ground (leading to incomplete snow removal).

Figure 10A:
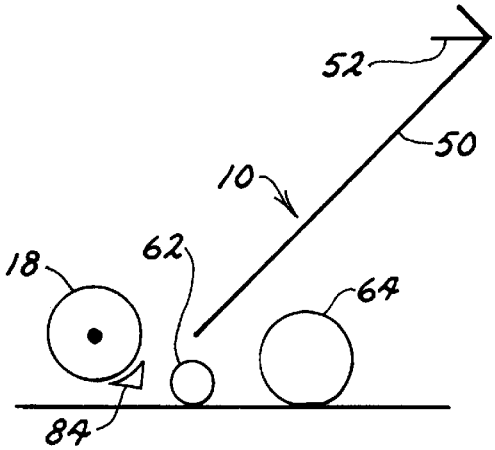
FIG. 10*a* is a diagrammatic side elevational illustration of a single-stage snow thrower according to the present invention, depicting a non-propelled condition.

FIGS. 4 and 10*a* illustrates the snowthrower 10 prior to operation of the impeller 18, as in its nonoperational condition. Snowthrower 10 is supported by both front and rear wheels 62,64 to promote easy movement of the snowthrower 10, as during storage and transport. The nonoperational impeller 18 does have an associated normal force, as it is displaced away from the ground surface by a distance '$X_i$' of approximately 0.75 inches. Operation of impeller 18 can be initiated by closing bail 52 toward handle assembly 50. This transfers power from the engine 44 to the impeller assembly 18 to rotate the impeller 18 in the direction of arrow 'R' in FIG. 4. As the bail 52 is closed toward handle assembly 50 about a predetermined angle, the clutch control cable 58 is biased to place the impeller clutch (not shown) into an operational condition. Upon activation of the impeller clutch, the impeller 18 is coupled to the engine 44 and begins rotation.

Figure 10B:
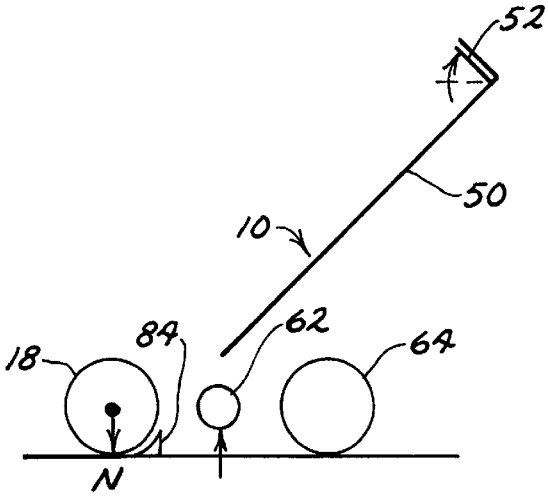
FIG. 10*b* is a diagrammatic side elevational illustration of a single-stage snowthrower according to the present invention, depicting a propelled condition.

Referring now to FIGS. 2, 5 and 10*b*, as the bail 52 is further closed toward the handle assembly 50 (past the point of clutch engagement) the drive control linkage 60 biases the lever plate 90 to rotate about its axis of rotation and initiate the impeller housing 12 movement relative the frame 14 (to decrease the distance $X_i$). As the pivot rod 92 and crank 94 are directly coupled to the lever plate 90, they rotate about the axis of rotation as the lever plate 90 is upwardly biased about its pivot axis by the drive control cable 60. Connecting arm 96 is upwardly displaced by the crank arm 94 to bias the impeller housing 12 about impeller housing 12 pivot axis 68. As impeller housing 12 moves about its pivot axis 68, the distance, $X_i$, between the impeller 18 and the ground is decreased. Depending on the degree of movement, the scraper 84 may be biased into ground contact and tilt or deflect upwardly as provided by the foam insert 144 between scraper 84 and frame 14 (FIG. 8). Additionally, the front wheel set 62 may be lifted away from ground contact to increase the scraping action of the scraper 84. In the maximum drive force position of bail assembly 52 relative handle 50 (FIGS. 1 and 5) the front wheels may be displaced approximately 0.25 inches away from the ground surface. By varying the degree to which the bail 52 is closed toward the handle 50, the degree of ground contact and the normal force, N, of the impeller 18 may be varied. Importantly, as the impeller 18 normal force, N, increases, the drive force developed to propel the snowthrower 10 increases. In this regard, a variable drive force is developed as the operator biases the bail 52 toward the handle assembly 50 to selectively adjust the normal force, N, associated with the rotating impeller 18. The operator may selectively adjust or "feather" the drive force by positioning the bail 52 at an intermediate position relative the handle 50. FIG. 5 illustrates the snowthrower 10 with the bail assembly 52 fully closed against the handle assembly 50, resulting in an increased normal force, N, and drive force. Of course, if the handle assembly 50 is lifted by the operator an additional drive force may be developed (as the normal force, N, may be further increased). The maximum angular movement of the lever plate 90 may be limited by an abutment edge 150 of the lever plate 90 contacting a portion of the frame cross brace member 76. Comparing FIGS. 9*b* and 10*b*, to generate the self propelled function of the impeller 18, the handle 50 of the prior art single-stage snowthrower 10 is displaced across a substantially larger arc, β, than the handle 50 of the snowthrower 10 according to the present invention. The handle 50 of the snowthrower 10 of the present invention may pivot slightly about the rear wheel 64 axis as the bail assembly 52 is actuated toward handle 50. Still with reference to FIGS. 2, 5, and 10, the rear wheels 64 of the snowthrower 10 according to present invention maintain ground contact when the impeller housing 12 is displaced to effectuate the self-propelling action. As the impeller housing 12 pivots relative to the frame 14 to increase the impeller 18 normal force, N, the rear wheels 64 of the snowthrower 10 remain in contact with the ground surface. This promotes machine stability and tends to counteract any moment forces developed by the ejected snow and otherwise minimizes sliding or skating of the snowthrower 10 on low friction surfaces.

From the foregoing, it will be apparent that the present invention defines an improved single-stage snowthrower having several advantages over the prior art. One particular advantage is the provision of a snowthrower 10 having variable self-propulsion control. Another advantageous feature of the present invention is a pivotable impeller housing 12 for selectively controlling the normal force associated with impeller 18. Additionally, an advantageous feature of the present invention is a bail assembly 52 for selectively controlling the propulsive drive of a single-stage snowthrower 10. One preferred approach to selectively controlling the propulsive drive is by pivoting the impeller 18 into increasing contact with the ground surface. Another approach may be to simply vertically displace the impeller 18 into increasing contact with the ground surface to selectively control the propulsive drive force (impeller 18 normal force, N) of a single-stage snowthrower 10.

Although particular embodiments of the invention have been illustrated in the accompanying Drawings and described in the foregoing Detailed Description, it will be understood that the invention is not limited only to the embodiments disclosed, but is intended to embrace any alternatives, equivalents, or modifications falling within the scope of the invention as defined by the following claims.

What is claimed is:

1. A single-stage snowthrower for use on a ground surface, said snowthrower comprising:

a frame;

a handle coupled to the frame, said handle for directing the snowthrower across the ground surface;

an impeller coupled to the frame and in engaging contact with the ground surface, said impeller having a force normal to the ground surface associated with the engaging contact with the ground surface; and an impeller positioning device coupled to the snowthrower, said impeller positioning device being movable relative to the handle between a first orientation and a second orientation, wherein when the impeller positioning device is in said first orientation the normal force developed between the impeller and the ground surface is a first value, and wherein when the impeller positioning device is in the second orientation the normal force is a second value different than the first value.

2. A single-stage snowthrower of claim 1, further comprising:

an engine for powering the impeller.

3. A single-stage snowthrower of claim 1, further comprising:

an impeller housing for carrying the impeller, said impeller housing being pivotally coupled to the frame.

4. A single-stage snowthrower of claim 3, wherein the engine is rigidly coupled to the impeller housing.

5. A single-stage snowthrower of claim 3, wherein an axis of pivot of the impeller housing is substantially parallel with an impeller axis of rotation.

6. A single-stage snowthrower of claim 3, wherein the impeller positioning device pivots the impeller housing about an axis of pivot.

7. A single-stage snowthrower of claim 1, wherein the impeller positioning device is coupled to the handle.

8. A single-stage snowthrower of claim 7, wherein the impeller positioning device includes a movable element disposed proximate a distal end of the handle.

9. A single-stage snowthrower, comprising:

a frame;

an impeller coupled with the frame and in engaging contact with the ground surface, said impeller having a force normal to the ground surface associated with the engaging contact with the ground surface, said impeller being movably coupled relative to the frame; and an impeller positioning device coupled with the impeller, said impeller positioning device being movable relative to the frame between a first orientation and a second orientation, wherein when the impeller positioning device is in the first orientation the normal force between the impeller and the ground surface is a first value, and wherein when the impeller positioning device is in the second orientation the normal force is a second value different than the first value.

10. A single-stage snowthrower of claim 9, wherein the impeller includes an impeller housing for carrying the impeller, said impeller housing being pivotally coupled to the frame.

11. A single-stage snowthrower of claim 10, wherein an axis of pivot of the impeller housing is substantially parallel with an axis of impeller rotation.

12. A single-stage snowthrower of claim 10, wherein an engine is rigidly coupled to the impeller housing.

13. A single-stage snowthrower of claim 10, further comprising a handle coupled to the frame for controlling the snowthrower.

14. A single-stage snowthrower of claim 13, wherein the impeller positioning device is coupled to the handle.

15. A single-stage snowthrower of claim 14, wherein the impeller positioning device includes a bail element disposed proximate a distal end of the handle.

16. A single-stage snowthrower of claim 9, wherein:

said impeller positioning device is movable between a plurality of orientations relative to the frame, and wherein a predetermined propulsive drive force is associated with each one of the plurality of orientations of the impeller positioning device.

17. A single-stage snowthrower for clearing snow from a ground surface, said snowthrower comprising:

a frame;

an impeller coupled to the frame, said impeller being in engaging contact with the ground surface and having an associated force normal to the ground surface; and a propulsion control structure coupled to the snowthrower, at least a portion of said propulsion control structure being movable relative to the snowthrower between a plurality of orientations, including a first orientation wherein the normal force developed between the impeller and the ground surface is a first value, and a second orientation wherein the normal force is a second value larger than the first value.

18. A single-stage snowthrower of claim 17, further comprising:

an impeller housing for carrying the impeller, said impeller housing being pivotally coupled to the frame.

19. A single-stage snowthrower of claim 18, wherein the propulsion control structure pivots the impeller housing about a pivot axis.

20. A single-stage snowthrower of claim 18, wherein an axis of pivot of the impeller housing is substantially parallel with an axis of impeller rotation.

21. A single-stage snowthrower of claim 18, wherein an engine is coupled to the impeller housing.

22. A single-stage snowthrower of claim 17, further comprising a handle coupled to the frame.

23. A single-stage snowthrower of claim 22, wherein the propulsion control structure is coupled to the handle.

24. A single-stage snowthrower of claim 23, wherein the propulsion control structure includes a bail element disposed proximate a distal end of the handle.

25. A single-stage snowthrower of claim 17, wherein a different normal force is associated with each one of the plurality of orientations of the propulsion control structure.

26. A method of operating a single-stage snowthrower, said method including the steps of:

providing a frame;

coupling a snow-contacting impeller to the frame, said impeller being in engaging contact with the ground surface to provide a force normal to the ground surface;

providing a propulsion control structure upon the snowthrower, at least a portion of said propulsion control structure being movable relative to the frame between at least a pair of operational conditions including a first operational condition wherein the normal force developed between the impeller and the ground surface is a first value, and a second operational condition wherein the normal force is a second value larger than the first value; and changing the propulsion control structure from its first operational condition to its second operational condition to increase the normal force of the impeller and to provide an increased propulsive assist force to the snow thrower.

27. The method of operating a single-stage snow thrower of claim 26, wherein the step of providing a propulsion control structure includes providing an operator movable bail control device upon a handle.

28. The method of operating a single-stage snow thrower of claim 27, wherein the step of changing the propulsion control structure is achieved by manipulating the bail control device relative to the handle.

29. The method of operating a single-stage snow thrower of claim 26, wherein the step of changing the propulsion control structure results in the impeller moving relative to the frame.

30. The method of operating a single-stage snow thrower of claim 29, wherein the step of changing the propulsion control structure results in the impeller pivotally moving relative to the frame.

31. A single-stage snowthrower, comprising:

a frame;

an engine coupled to the frame;

an impeller coupled to the engine and in engaging contact with the ground surface, said impeller having a force normal to the ground surface associated with the engaging contact with the ground surface, said impeller being movably coupled relative to the frame wherein an impeller axis of rotation is movable relative to the frame; and an impeller positioning device being movably coupled relative to the frame between a first orientation and a second orientation, wherein when the impeller positioning device is in the first orientation the impeller axis of rotation is at a first distance away from the frame, and wherein when the impeller positioning device is in the second orientation the impeller axis of rotation is at a second distance away from the frame.

32. A single-stage snowthrower of claim 31, further comprising a handle coupled to the frame for controlling the snowthrower, and wherein the impeller positioning device is coupled to the handle.

33. A single-stage snowthrower for use on a ground surface, said snowthrower comprising:

a frame;

an impeller coupled to the frame and rotating about an axis of rotation, said impeller in engaging contact with the ground surface and having a force normal to the ground surface associated with the engaging contact with the ground surface, and an impeller positioning device coupled to the snowthrower and being movable between at least a pair of operational orientations, said impeller positioning device for controlling a position of the impeller axis of rotation relative to the frame, wherein when the impeller positioning device is in a first orientation the impeller axis of rotation is at a first distance away from the frame and a first normal force exists between the impeller and the ground surface, and wherein when the impeller positioning device is in a second orientation the impeller axis of rotation is at a second distance away from the frame and a second normal force substantially different that the first normal force exists between the impeller and the ground surface.

34. A single-stage snowthrower of claim 33, further comprising a handle coupled to the frame for controlling the snowthrower, and wherein the impeller positioning device is coupled to the handle.

* * * * *

UNITED STATES PATENT AND TRADEMARK OFFICE

CERTIFICATE OF CORRECTION

PATENT NO. : 6,470,602 B2
DATED : October 20, 2002
INVENTOR(S) : White, Donald M. III et al.

It is certified that error appears in the above-identified patent and that said Letters Patent is hereby corrected as shown below:

Column 4,
Line 13, the word "that" should be changed to -- than --.

Signed and Sealed this

Fourth Day of March, 2003

JAMES E. ROGAN
*Director of the United States Patent and Trademark Office*